US010008765B2

(12) United States Patent
Lin

(10) Patent No.: US 10,008,765 B2
(45) Date of Patent: Jun. 26, 2018

(54) ANTENNA STRUCTURE AND WIRELESS COMMUNICATION DEVICE USING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days. days.

(21) Appl. No.: 15/356,623

(22) Filed: Nov. 20, 2016

(65) Prior Publication Data

US 2017/0155186 A1 Jun. 1, 2017

(30) Foreign Application Priority Data

Nov. 30, 2015 (CN) ..... 2015 1 0858013

(51) Int. Cl.
*H01Q 1/24* (2006.01)
*H01Q 5/392* (2015.01)

(52) U.S. Cl.
CPC ..... *H01Q 1/243* (2013.01); *H01Q 5/392* (2015.01)

(58) Field of Classification Search
CPC ..... H01Q 1/24; H01Q 1/243
See application file for complete search history.

(56) References Cited

U.S. PATENT DOCUMENTS 9,070,969 B2 * 6/2015 Mow ..... H01Q 1/243
2012/0218163 A1 * 8/2012 Wong ..... H01Q 1/243 343/843
2013/0057437 A1 * 3/2013 Chiu ..... H01Q 1/243 343/702
2014/0266922 A1 * 9/2014 Jin ..... H01Q 21/28 343/702
2014/0333488 A1 * 11/2014 Wang ..... H01Q 1/243 343/702

* cited by examiner

*Primary Examiner* — Robert Karacsony
(74) *Attorney, Agent, or Firm* — ScienBiziP, P.C.

(57) ABSTRACT

An antenna structure includes a metallic member, a radiating portion, and a meander portion. The metallic member defines at least one slot and is divided into a first metallic portion and a second metallic portion by the at least one slot. The radiating portion is electrically connected to the first metallic portion and is configured to feed current to the first metallic portion. The meander portion is configured to activate a low-frequency mode of the antenna structure and maintain high-frequency characteristics of the antenna structure. The second metallic portion is spaced apart from the first metallic portion and is grounded. The meander portion includes a first end and a second end. The first end of the meander portion is electrically connected to the first metallic portion, and the second end of the meander portion is grounded.

20 Claims, 6 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201510858013.7 filed on Nov. 30, 2015, the contents of which are incorporated by reference herein.

FIELD

The subject matter herein generally relates to an antenna structure and a wireless communication device using the antenna structure.

BACKGROUND

Metal housings are widely used for wireless communication devices, such as mobile phones or personal digital assistants (PDAs). Antennas are also important components in wireless communication devices for receiving and transmitting wireless signals at different frequencies, such as wireless signals operated in a long term evolution (LTE) band. However, when the antenna is located in the metal housing, the antenna signals are often shielded by the metal housing. This can degrade the operation of the wireless communication device.

BRIEF DESCRIPTION OF THE DRAWINGS

Implementations of the present technology will now be described, by way of example only, with reference to the attached figures.

DETAILED DESCRIPTION

Figure 1:
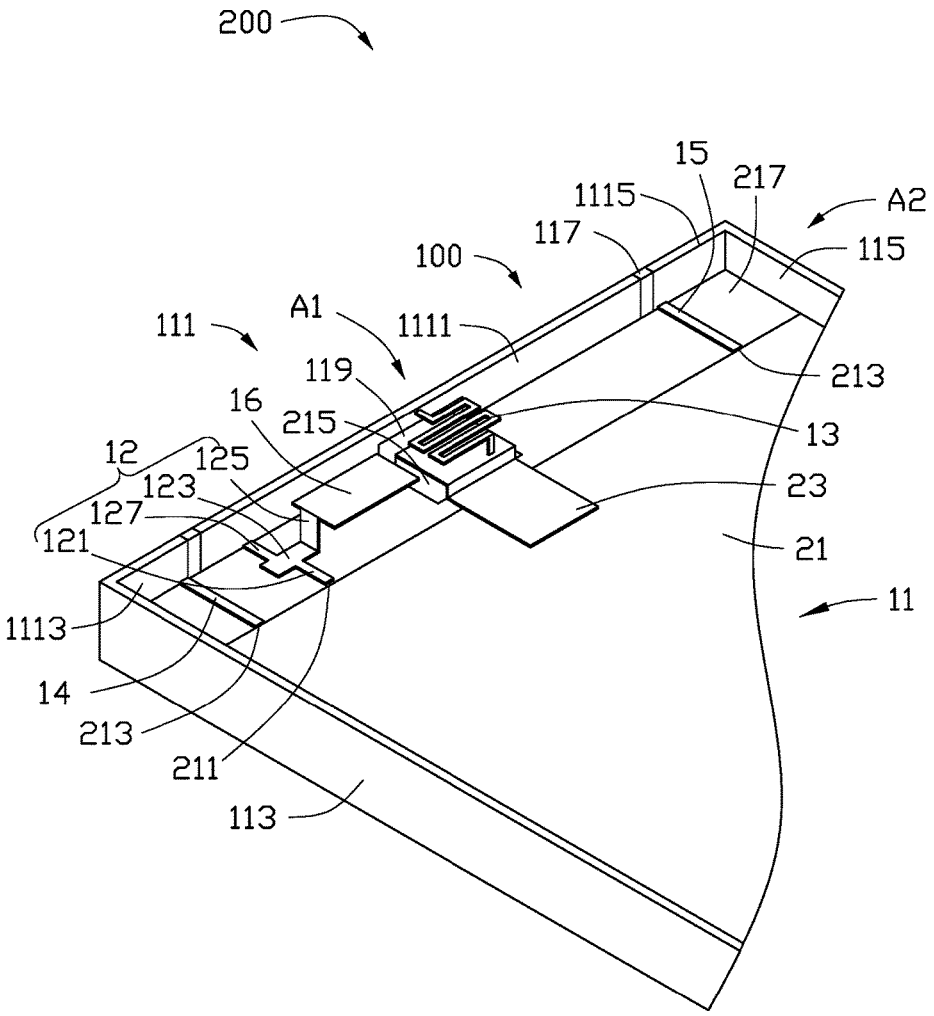
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 200 using a first exemplary antenna structure 100. The wireless communication device 200 can be a mobile phone or a personal digital assistant, for example. The antenna structure 100 is configured to receive/send wireless signals.

The wireless communication device 200 further includes a baseboard 21 and a flexible printed circuit (FPC) 23. The baseboard 21 can be made of a dielectric material, such as glass epoxy phenolic fiber (FR4). The baseboard 21 includes a feed point 211 and at least one ground point 213. The feed point 211 is configured to feed current to the antenna structure 100. In this exemplary embodiment, the baseboard 21 includes two ground points 213. The two ground points 213 are positioned at two sides of the feed point 211 and are configured to ground the antenna structure 100. The baseboard 21 further includes an electronic element 215 and a keep-out-zone 217. In this exemplary embodiment, the electronic element 215 can be a universal serial bus (USB) interface module. The electronic element 215 is positioned at a side of the baseboard 21 and is electrically connected to the baseboard 21. It can be understood that the electronic element 215 can also be a microphone, a camera, or other electronic element. The keep-out-zone 217 is positioned at the same side as the electronic element 215 of the baseboard 21 and surrounds the electronic element 215. The purpose of the keep-out-zone 217 is to delineate an area on the baseboard 21, in which other electronic elements (such as a camera, a vibrator, a speaker, a battery, a charge coupled device, etc.) cannot be placed to prevent the electronic element from interfering with the antenna structure 100.

The FPC 23 is positioned on the electronic element 215. The FPC 23 is electrically connected to a grounding system (not shown) of the antenna structure 100 to ground the electronic element 215.

The antenna structure 100 includes a metallic member 11, a radiating portion 12, a meander portion 13, and at least one ground portion.

The metallic member 11 can be a decorative member, for example, an external metallic frame of the wireless communication device 200. In this exemplary embodiment, the metallic member 11 is a frame structure and includes a first frame 111, a second frame 113, and a third frame 115. The second frame 113 is positioned apart from and parallel to the third frame 115. The first frame 111 has first and second ends. The second frame 113 is connected to the first end of the first frame 111 and the third frame 115 is connected to the second end of the first frame 111. The first frame 111 defines at least one slot 117. The first frame 111 is divided into a plurality of combining portions. One of the plurality of combining portions can act as a first metallic portion A1 of the metallic member 11 and a radiator of the antenna structure 100 to receive/send wireless signals. The remainder of the plurality of combining portions can combine with the second frame 113 and the third frame 115 to cooperatively form a second metallic portion A2. The second metallic portion is grounded.

In this exemplary embodiment, the first frame 111 defines two slots 117. Then the first frame 111 is divided into three combining portions by the two slots 117. The three combining portions include a first combining portion 1111, a second combining portion 1113, and a third combining portion 1115. The first combining portion 1111 acts as the first metallic portion A1 of the metallic member 11 and further acts as the radiator of the antenna structure 100 to receive/send wireless signal. The second combining portion 1113 is connected to the second frame 113. The third combining portion 1115 is connected to the third frame 115. Then the second combining portion 1113, the third combining portion 1115, the second frame 113, and the third frame 115 cooperatively form the second metallic portion A2 of the metallic member 11. The second metallic portion acts the grounding system of the antenna structure 100 to ground the antenna structure 100.

The metallic member 11 further defines an opening 119. In this exemplary embodiment, the opening 119 is defined on the first metallic portion A1 of the metallic member 11. The electronic element 215 can be exposed from the opening 119. A USB device can pass through the opening 119 and can be received in the electronic element 215 to establish an electrical connection between the USB device and the wireless device 200.

The radiating portion 12 is a monopole antenna. In this exemplary embodiment, the radiating portion 12 includes a feed section 121, a first connecting section 123, a second connecting section 125, and a radiating section 127. The feed section 121 is substantially a strip. One end of the feed section 121 is electrically connected to the feed point 211. Another end of the feed section 121 extends along a direction parallel to the second frame 113, towards the first frame 111, and further connects to the first connecting section 123.

The first connecting section 123 is positioned coplanar with the feed section 121. The first connecting section 123 is substantially a rectangular sheet. One end of the first connecting section 123 is perpendicularly connected to an end of the feed section 121 away from the feed point 211. Another end of the first connecting section 123 extends along a direction parallel to the first frame 111 and towards the third frame 115 until the first connecting section 123 is perpendicularly connected to the second connecting section 125.

The second connecting section 125 is positioned in a plane substantially perpendicular to another plane where the first connecting section 123 is positioned. The second connecting section 125 is perpendicularly connected to the first connecting section 123 and extends along a direction parallel to the second frame 113 and away from the baseboard 21. The radiating section 127 is positioned coplanar with the feed section 121 and the first connecting section 123. One end of the radiating section 127 is perpendicularly connected to a side of the first connecting section 123 away from the feed section 121. Another end of the radiating section 127 extends along a direction parallel to the second frame 113 and towards the first frame 111 until the radiating section 127 is electrically connected to the first metallic portion A1. Then a signal from the radiating section 127 can be feed to the first metallic portion A1.

The meander portion 13 is a meander strip that has a shape resembling bending pipes as shown in FIG. 1. In this exemplary embodiment, the meander portion 13 is positioned above the electronic element 215. One end of the meander portion 13 is electrically connected to the first metallic portion. Another end of the meander portion 13 is electrically connected to the FPC 23 and is grounded through the FPC 23. The meander portion 13 is configured to activate a low-frequency mode of the antenna structure 100 through a high-inductance characteristics of the meander portion 13 and to maintain a high-frequency characteristics of the antenna structure 100.

In this exemplary embodiment, the antenna structure 100 includes two ground portions. The two ground portions include a first ground portion 14 and a second ground portion 15. The first ground portion 14 and the second ground portion 15 are both rectangular. The first ground portion 14 and the second ground portion 15 are configured to ground the antenna structure 100 and to adjust a resonating mode of the antenna structure 100 in the high-frequency band. In detail, one end of the first ground portion 14 is electrically connected to the second metallic portion, for example, the second combining portion 1113. Another end of the first ground portion 14 is electrically connected to a grounding point 213. The second ground portion 15 is positioned at another side of the electronic element 215. One end of the second ground portion 15 is electrically connected to the second metallic portion, for example, the third combining portion 1115. Another end of the second ground portion 15 is electrically connected to another grounding point 213.

In other exemplary embodiments, the antenna structure 100 further includes an extending portion 16. The extending portion 16 is substantially a rectangular sheet. The extending portion 16 is positioned in a plane substantially parallel to another plane where the first connecting section 123 is positioned. A width of the extending portion 16 is greater than a width of the second connecting section 125. One end of the extending portion 16 is electrically connected to one end of the second connecting section 125 away from the first connecting section 123. Another end of the extending portion 16 extends along a direction parallel to the first frame 111 and away from the second frame 113. The extending portion 16 is configured to activate a high-frequency mode of the antenna structure 100 and improve a bandwidth of the high-frequency band of the antenna structure 100.

Figure 2:
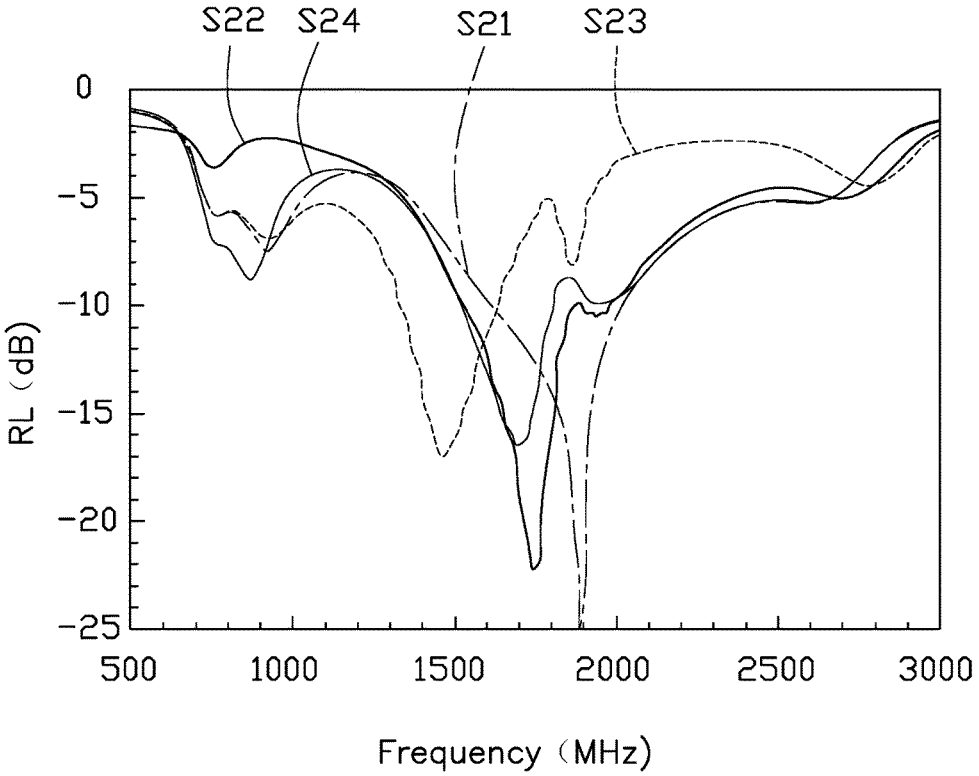
FIG. 2 is a return loss graph of the antenna structure of FIG. 1.

FIG. 2 illustrates a return loss graph of the antenna structure 100. Curve S21 illustrates a return loss of the antenna structure 100. Curve S22 illustrates a return loss of the antenna structure 100 when the antenna structure 100 does not include the meander portion 13. Curve S23 illustrates a return loss of the antenna structure 100 when the antenna structure 100 does not include the first ground portion 14. Curve S24 illustrates a return loss of the antenna structure 100 when the antenna structure 100 does not include the second ground portion 15. In view of the curves S21-S24, when the antenna structure 100 operates at a first frequency band (704-960 MHz) and a second frequency band (1360-2690 MHz), the return loss of the antenna structure 100 satisfies design of the antenna. When the antenna structure 100 includes the meander portion 13, the antenna structure 100 has a good bandwidth and a good impedance matching in the low-frequency band compared with the antenna structure that does not include the meander portion 13. Additionally, the first ground portion 14 and the second ground portion 15 are configured to improve a bandwidth of the high-frequency band of the antenna structure 100.

Figure 3:
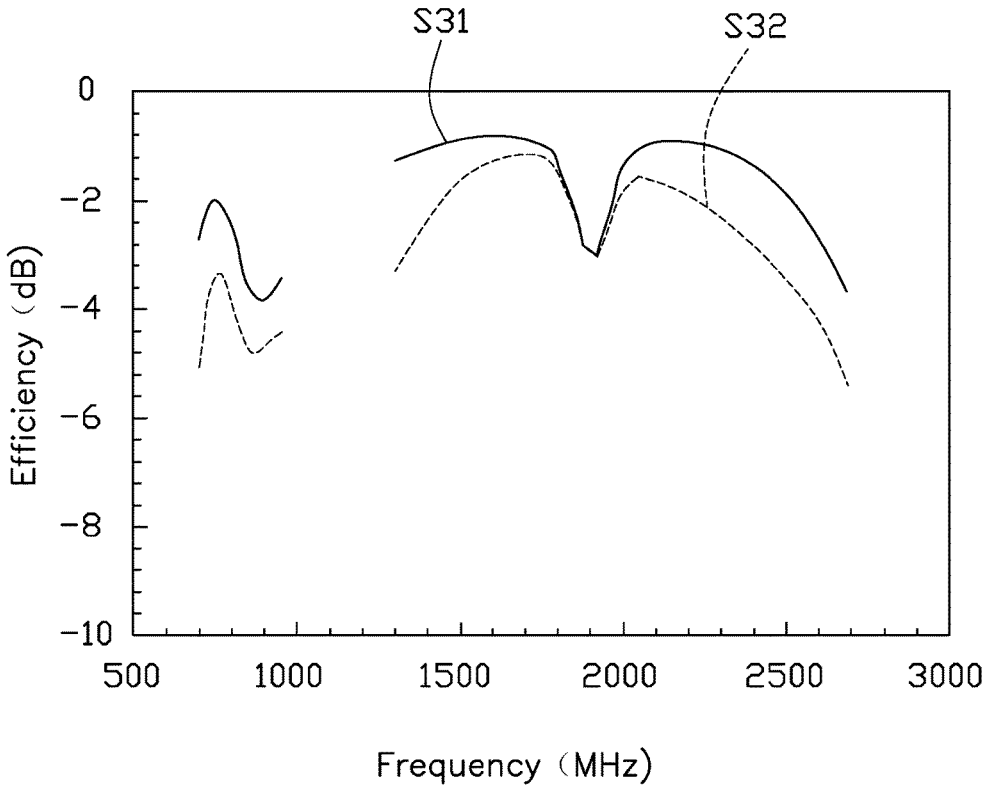
FIG. 3 is a radiating efficiency graph of the antenna structure of FIG. 1.

FIG. 3 illustrates a radiating efficiency graph of the antenna structure 100. Curve S31 illustrates a radiating efficiency of the antenna structure 100. Curve S32 illustrates a total radiating efficiency of the antenna structure 100. It can be derived from FIG. 3 that when the antenna structure 100 operates at the first frequency band (704-960 MHz) and the second frequency band (1360-2690 MHz), the antenna structure 100 has a good radiating performance.

Figure 4:
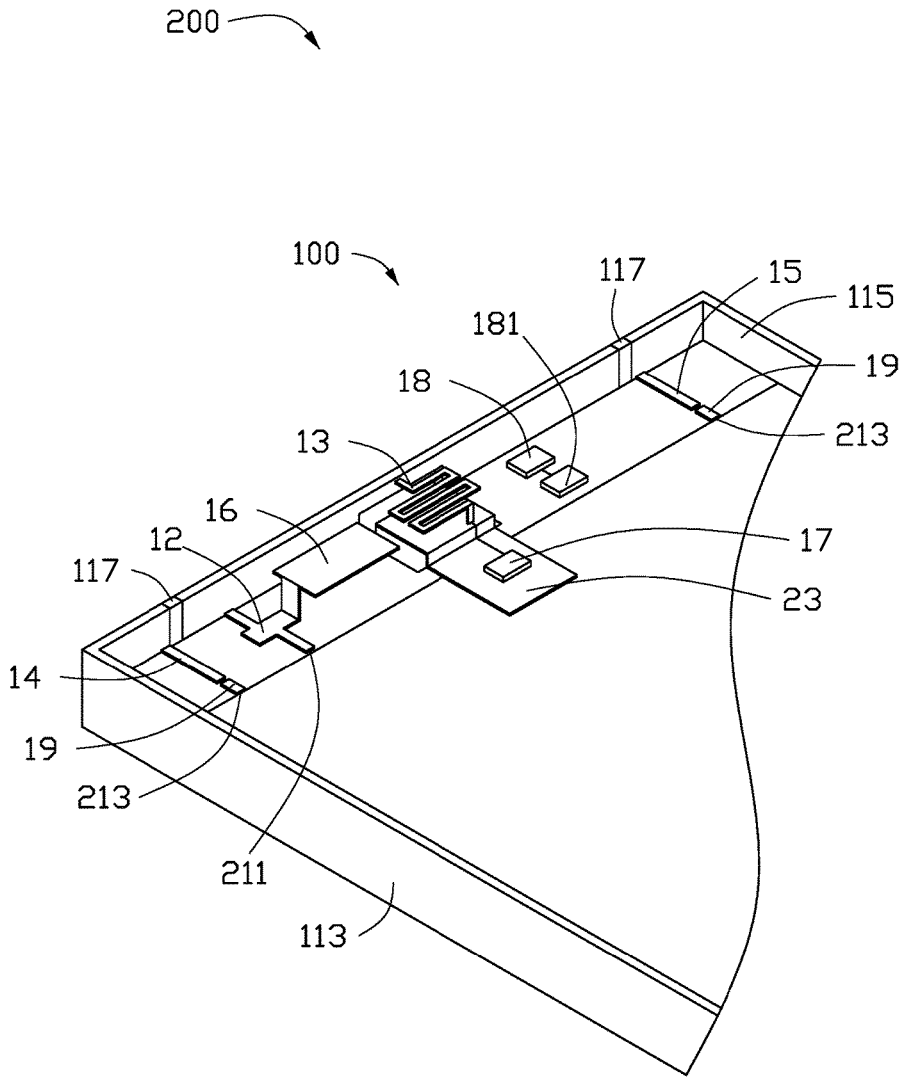
FIG. 4 is an isometric view of a second exemplary embodiment of a wireless communication device using a second exemplary antenna structure.

As illustrated in FIG. 4, in a second exemplary embodiment, the antenna structure 100 further includes a first switching circuit 17. The first switching circuit 17 is positioned on the FPC 23. One end of the first switching circuit 17 is electrically connected to the meander portion 13. Another end of the first switching circuit 17 is grounded. The first switching circuit 17 can include a plurality of inductors and/or capacitors. The first switching circuit 17 is configured to switch to different inductors or capacitors for adjusting a resonance frequency of the antenna structure 100. The first switching circuit 17 can be grounded through the metallic plane of the electronic element 215. That is, the antenna structure 100 and the electronic element 215 can share the grounding plane to increase a keep-out-zone of the antenna structure 100 and improve characteristics of an antenna.

Figure 5:
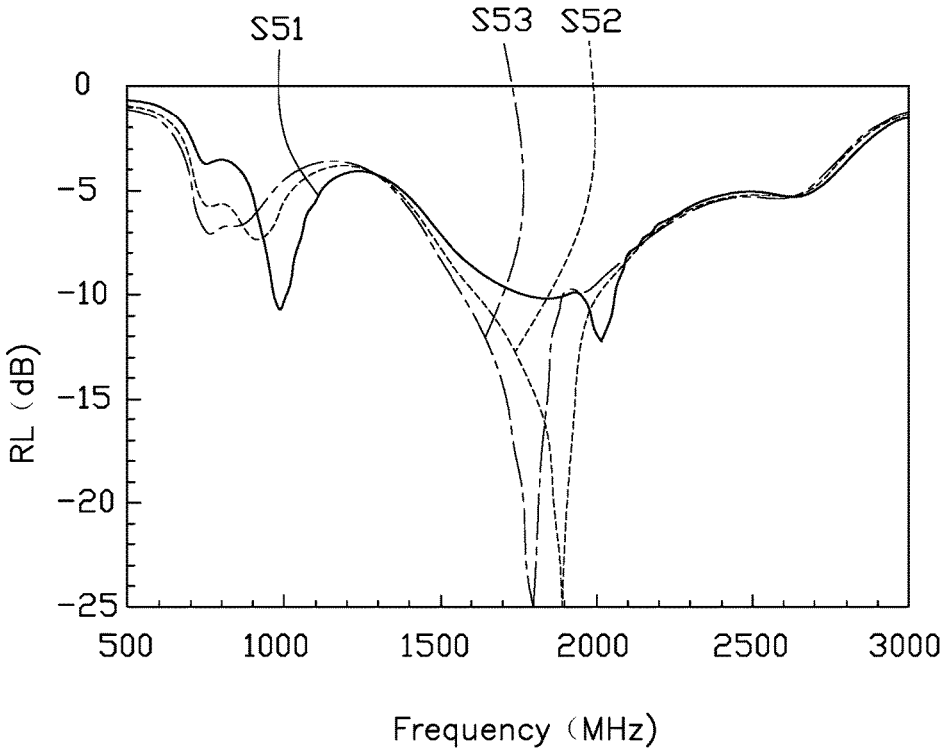
FIG. 5 is a return loss graph of the antenna structure of FIG. 4.

FIG. 5 illustrates a return loss graph of the antenna structure 100 when the antenna 100 includes the first switching circuit 17. Curve S51 illustrates a return loss of the antenna structure 100 when the first switching circuit 17 switches to an inductor having an inductance of about 1 nH. Curve S52 illustrates a return loss of the antenna structure 100 when the first switching circuit 17 switches to an inductor having an inductance of about 5 nH. Curve S53 illustrates a return loss of the antenna structure 100 when the first switching circuit 17 switches to an inductor having an inductance of about 8 nH. It can be derived from FIG. 5 that in the low-frequency band, an increase of inductance will lead to a frequency of the antenna structure 100 shifting to the low-frequency band and does not affect a bandwidth of the high-frequency band.

As illustrated in FIG. 4, the antenna structure 100 further includes a resonating portion 18. The resonating portion 18 is positioned between the meander portion 13 and the second ground portion 15. The resonating portion 18 is further grounded through a high-pass filter 181. In this exemplary embodiment, the resonating portion 18 is configured to improve isolation of the radiating portion 12 and to increase a bandwidth of the antenna structure 100.

In other exemplary embodiments, the antenna structure 100 further includes a second switching circuit 19. In this exemplary embodiment, the antenna structure 100 includes two second switching circuits 19. The first ground portion 14 and the second ground portion 15 are both grounded through one second switching circuit 19 to improve high-frequency characteristics of the antenna structure 100.

Figure 6:
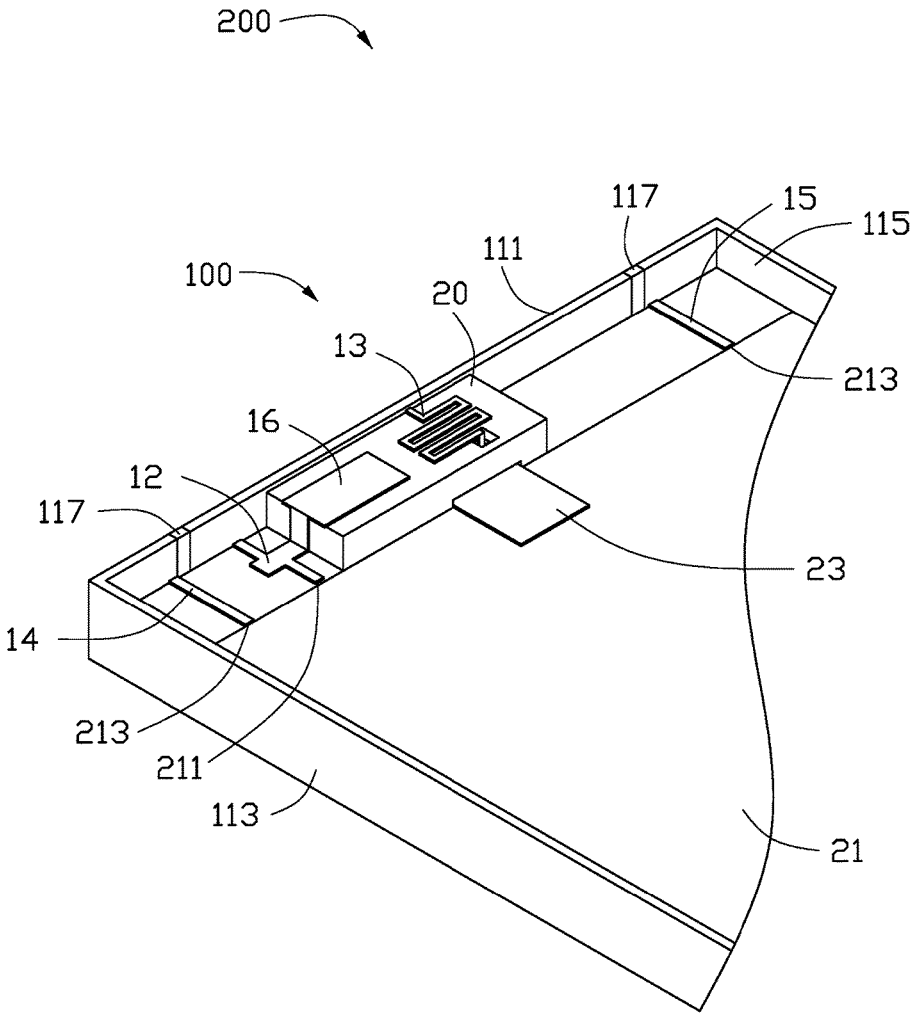
FIG. 6 is an isometric view of a third exemplary embodiment of a wireless communication device using a third exemplary antenna structure.

As illustrated in FIG. 6, in other exemplary embodiments, the antenna structure 100 further includes a holder 20. The holder 20 is positioned above the electronic element 215. The holder 20 is configured to receive the electronic element 215 and support the meander portion 13 and the extending portion 16.

In other exemplary embodiments, the meander portion 13 is not limited to be positioned above the electronic element 215 and can be positioned at a side of the electronic element 215.

In other exemplary embodiments, the antenna structure 100 can further include a matching circuit (not shown). The matching circuit is electrically connected to the feed point 211. The matching circuit is configured to improve impedance matching and radiating efficiency of the antenna structure 100.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metallic member, the metallic member comprising a first frame, a second frame, and a third frame, the second frame positioned apart from and parallel to the third frame, the second frame and the third frame respectively connected to two ends of the first frame; the metallic member further defining at least one slot and being divided into a first metallic portion and a second metallic portion by the at least one slot;

a radiating portion, one end of the radiating portion electrically connected to a feed point, another end of the radiating portion electrically connected to the first metallic portion and configured to feed current to the first metallic portion;

a meander portion configured to activate a low-frequency mode of the antenna structure and maintain high-frequency characteristics of the antenna structure; and an extending portion;

wherein the second metallic portion is spaced apart from the first metallic portion and is grounded, the meander portion comprises a first end and a second end, the first end of the meander portion is electrically connected to the first metallic portion, and the second end of the meander portion is grounded; and wherein the radiating portion comprises a first connecting section and a second connecting section, the first connecting section is coupled between the feed point and the first metallic portion, one end of the second connecting section is connected to the first connecting section, the extending portion is connected to another end of the second connecting section and is positioned in a plane parallel to another plane where the first connecting section is positioned.

2. The antenna structure of claim 1, wherein the at least one slot is defined on the first frame, the first frame is divided into a plurality of combining portions, one of the plurality of combining portions acts a first metallic portion of the metallic member and a radiator of the antenna structure to receive/send wireless signals, the remainder of the plurality of combining portions combine with the second frame and the third frame to cooperatively form the second metallic portion, and the second metallic portion is grounded.

3. The antenna structure of claim 1, wherein the radiating portion further comprises a feed section and a radiating section, one end of the feed section is electrically connected to the feed point; wherein another end of the feed section extends along a direction parallel to the second frame and towards the first frame, and further connects to the first connecting section; the first connecting section is positioned coplanar with the feed section, one end of the first connecting section is perpendicularly connected to an end of the feed section away from the feed point, another end of the first connecting section extends along a direction parallel to the first frame and towards the third frame until the first connecting section is perpendicularly connected to the second connecting section; the second connecting section is positioned in a plane substantially perpendicular to another plane where the first connecting section is positioned, the second connecting section is perpendicularly connected to the first connecting section, the radiating section is positioned coplanar with the feed section and the first connecting section, one end of the radiating section is perpendicularly connected to a side of the first connecting section away from the feed section, another end of the radiating section extends along a direction parallel to the second frame and towards the first frame until the radiating section is electrically connected to the first metallic portion.

4. The antenna structure of claim 1, wherein one end of the extending portion is electrically connected to one end of the second connecting section away from the first connecting section, another end of the extending portion extends along a direction parallel to the first frame and away from the second frame.

5. The antenna structure of claim 1, further comprising at least one ground portion, one end of the at least one ground portion is electrically connected to a ground point, another end of the at least one ground portion is electrically connected to the second metallic portion to ground the second metallic portion.

6. The antenna structure of claim 1, further comprising a first switching circuit, wherein one end of the first switching circuit is electrically connected to the meander portion, another end of the first switching circuit is grounded, the first switching circuit comprises a plurality of inductors and/or capacitors, the first switching circuit is configured to switch to different inductors or capacitors for adjusting a resonance frequency of the antenna structure.

7. The antenna structure of claim 2, further comprising a resonating portion, wherein the resonating portion is positioned between the meander portion and the third frame, the resonating portion is grounded through a high-pass filter and is configured to improve isolation of the radiating portion and to increase a bandwidth of the antenna structure.

8. The antenna structure of claim 5, further comprising at least one second switching circuit, wherein each ground portion is grounded through one second switching circuit to improve high-frequency characteristics of the antenna structure.

9. A wireless communication device comprising:

a baseboard, the baseboard comprising a feed point; and an antenna structure comprising:

a metallic member surrounding the baseboard, the metallic member being an external metallic frame of the wireless communication device, the metallic member comprising a first frame, a second frame, and a third frame, the second frame positioned apart from and parallel to the third frame, the second frame and the third frame respectively connected to two ends of the first frame; the metallic member further defining at least one slot and being divided into a first metallic portion and a second metallic portion by the at least one slot;

a radiating portion, one end of the radiating portion electrically connected to the feed point, another end of the radiating portion electrically connected to the first metallic portion and configured to feed current to the first metallic portion;

a meander portion configured to activate a low-frequency mode of the antenna structure and maintain a high-frequency characteristics of the antenna structure; and an extending portion;

wherein the second metallic portion is spaced apart from the first metallic portion and is grounded, the meander portion comprises a first end and a second end, the first end of the meander portion is electrically connected to the first metallic portion, and the second end of the meander portion is grounded; and wherein the radiating portion comprises a first connecting section and a second connecting section, the first connecting section is coupled between the feed point and the first metallic portion, one end of the second connecting section is connected to the first connecting section, the extending portion is connected to another end of the second connecting section and is positioned in a plane parallel to another plane where the first connecting section is positioned.

10. The wireless communication device of claim 9, wherein the baseboard further comprises at least one ground point, the at least one ground point is electrically connected to the second metallic portion.

11. The wireless communication device of claim 9, wherein the baseboard comprises an electronic element and a flexible printed circuit (FPC), the FPC is positioned on the electronic element, the meander portion is positioned above or on a side of the electronic element and is grounded through the FPC.

12. The wireless communication device of claim 11, wherein the antenna structure further comprises a holder, the holder is positioned above the electronic element, the holder is configured to receive the electronic element and support the meander portion.

13. The wireless communication device of claim 9, wherein the at least one slot is defined on the first frame, the first frame is divided into a plurality of combining portions, one of the plurality of combining portions act a first metallic portion of the metallic member and a radiator of the antenna structure to receive/send wireless signals, the remainder of the plurality of combining portions combine with the second frame and the third frame to cooperatively form a second metallic portion, and the second metallic portion is grounded.

14. The wireless communication device of claim 9, wherein the radiating portion further comprises a feed section and a radiating section, one end of the feed section is electrically connected to the feed point; wherein another end of the feed section extends along a direction parallel to the second frame and towards the first frame, and further connects to the first connecting section; the first connecting section is positioned coplanar with the feed section, one end of the first connecting section is perpendicularly connected to an end of the feed section away from the feed point, another end of the first connecting section extends along a direction parallel to the first frame and towards the third frame until the first connecting section is perpendicularly connected to the second connecting section; the second connecting section is positioned in a plane substantially perpendicular to another plane where the first connecting section is positioned, the second connecting section is perpendicularly connected to the first connecting section, the radiating section is positioned coplanar with the feed section and the first connecting section, one end of the radiating section is perpendicularly connected to a side of the first connecting section away from the feed section, another end of the radiating section extends along a direction parallel to the second frame and towards the first frame until the radiating section is electrically connected to the first metallic portion.

15. The wireless communication device of claim 9, wherein one end of the extending portion is electrically connected to one end of the second connecting section away from the first connecting section, another end of the extending portion extends along a direction parallel to the first frame and away from the second frame.

16. The wireless communication device of claim 9, wherein the antenna structure comprises at least one ground portion, one end of the at least one ground portion is electrically connected to a ground point, another end of the at least one ground portion is electrically connected to the second metallic portion to ground the second metallic portion.

17. The wireless communication device of claim 9, wherein the antenna structure comprises a first switching circuit, wherein one end of the first switching circuit is electrically connected to the meander portion, another end of the first switching circuit is grounded, the first switching circuit comprises a plurality of inductors and/or capacitors, the first switching circuit is configured to switch to different inductors or capacitors for adjusting a resonance frequency of the antenna structure.

18. The wireless communication device of claim 13, wherein the antenna structure comprises a resonating portion, wherein the resonating portion is positioned between the meander portion and the third frame, the resonating portion is grounded through a high-pass filter and is configured to improve isolation of the radiating portion and to increase a bandwidth of the antenna structure.

19. The wireless communication device of claim 16, wherein the antenna structure comprises at least one second switching circuit, wherein each ground portion is grounded through one second switching circuit to improve high-frequency characteristics of the antenna structure.

20. An antenna structure comprising:

a metallic member, the metallic member comprising a first frame, a second frame, and a third frame, the second frame positioned apart from and parallel to the third frame, the second frame and the third frame respectively connected to two ends of the first frame; the metallic member further defining at least one slot and being divided into a first metallic portion and a second metallic portion by the at least one slot;

a radiating portion, the radiating portion electrically connected to the first metallic portion and configured to feed current to the first metallic portion;

a meander portion configured to activate a low-frequency mode of the antenna structure and maintain high-frequency characteristics of the antenna structure; and a resonating portion;

wherein the second metallic portion is spaced apart from the first metallic portion and is grounded, the meander portion comprises a first end and a second end, the first end of the meander portion is electrically connected to the first metallic portion, and the second end of the meander portion is grounded; and wherein the resonating portion is positioned between the meander portion and the third frame, the resonating portion is grounded through a high-pass filter and is configured to improve isolation of the radiating portion and to increase a bandwidth of the antenna structure.

* * * * *